US010255839B2

(12) United States Patent
Lee et al.

(10) Patent No.: US 10,255,839 B2
(45) Date of Patent: Apr. 9, 2019

(54) DRIVING UNIT, DISPLAY DEVICE AND METHOD OF DRIVING A DISPLAY PANEL

(71) Applicant: SAMSUNG DISPLAY CO., LTD., Yongin, Gyeonggi-Do (KR)

(72) Inventors: Jae-Hoon Lee, Seoul (KR); Do-Hyung Ryu, Yongin-si (KR); Seung-Ho Park, Suwon-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 240 days.

(21) Appl. No.: 14/674,488

(22) Filed: Mar. 31, 2015

(65) Prior Publication Data

US 2016/0117973 A1 Apr. 28, 2016

(30) Foreign Application Priority Data

Oct. 28, 2014 (KR) ..... 10-2014-0147789

(51) Int. Cl.

| | |
|---|---|
| ***G09G 3/20*** | (2006.01) |
| ***G09G 3/3275*** | (2016.01) |
| ***G09G 3/32*** | (2016.01) |

(52) U.S. Cl.

CPC ..... *G09G 3/2055* (2013.01); *G09G 3/2051* (2013.01); *G09G 3/32* (2013.01); *G09G 3/3275* (2013.01); *G09G 2310/027* (2013.01); *G09G 2320/0257* (2013.01); *G09G 2320/0271* (2013.01); *G09G 2320/048* (2013.01);

(Continued)

(58) Field of Classification Search

CPC ..... G09G 3/2055; G09G 3/2051; G09G 3/32; G09G 3/3275; G09G 2320/048; G09G 2320/103; G09G 2340/0428; G09G 2320/0646; G09G 2320/0271;

(Continued)

(56) References Cited

U.S. PATENT DOCUMENTS 5,389,948 A * 2/1995 Liu ..... G09G 5/02 345/691
5,818,971 A * 10/1998 Moolenaar ..... H04N 1/405 382/252

(Continued)

FOREIGN PATENT DOCUMENTS

CN 1667683 A 9/2005
CN 1950871 A 4/2007

(Continued)

OTHER PUBLICATIONS

European Search Report dated Mar. 11, 2016 in Corresponding European Patent Application No. 15172171.9.

(Continued)

*Primary Examiner* — Mihir K Rayan
(74) *Attorney, Agent, or Firm* — Lee & Morse, P.C.

(57) ABSTRACT

A driver for a display panel includes a driving time accumulator, a ditherer, and a data signal generator. The driving time accumulator determines an accumulated driving time of the display panel. The ditherer determines an amount of dither based at least in part on the accumulated driving time, and performs a dithering operation on input image data with the determined amount of dither. The data signal generator generates a data signal for the display panel based at least in part on the input image data on which the dithering operation is to be performed.

17 Claims, 5 Drawing Sheets

(52) U.S. Cl.
CPC ..... *G09G 2320/0646* (2013.01); *G09G 2320/0666* (2013.01); *G09G 2320/103* (2013.01); *G09G 2340/0428* (2013.01)

(58) Field of Classification Search
CPC ..... G09G 2320/0666; G09G 2310/027; G09G 2320/0257
See application file for complete search history.

(56) References Cited

U.S. PATENT DOCUMENTS

| | | | | |
|---|---|---|---|---|
| 6,751,005 | B1 * | 6/2004 | Barnick | H04N 5/7416 348/E5.133 |
| 8,674,924 | B2 | 3/2014 | Nose | |
| 2002/0147861 | A1 * | 10/2002 | Bui | G06F 1/3218 710/1 |
| 2005/0200319 | A1 | 9/2005 | Yamano et al. | |
| 2005/0237319 | A1 * | 10/2005 | Ranganathan | G06F 1/3215 345/214 |
| 2006/0164407 | A1 | 7/2006 | Cok | |
| 2007/0263257 | A1 * | 11/2007 | Pai | G09G 3/2055 358/3.14 |
| 2008/0055288 | A1 | 3/2008 | Kawada et al. | |
| 2008/0158269 | A1 * | 7/2008 | Wang | G09G 3/2055 345/698 |
| 2008/0246703 | A1 | 10/2008 | Smith | |
| 2009/0051627 | A1 * | 2/2009 | Ihata | G09G 3/3208 345/76 |
| 2009/0195483 | A1 | 8/2009 | Naugler, Jr. et al. | |
| 2011/0254874 | A1 * | 10/2011 | Kikuta | G09G 3/2092 345/690 |
| 2016/0210903 | A1 * | 7/2016 | Jun | G09G 3/3266 |

FOREIGN PATENT DOCUMENTS

| | | | |
|---|---|---|---|
| CN | 101248480 | A | 8/2008 |
| CN | 101996599 | A | 3/2011 |
| EP | 2 028 637 | A2 | 2/2009 |
| KR | 10-2010-0016387 | A | 2/2010 |
| KR | 10-2012-0022411 | A | 2/2012 |
| KR | 10-2013-0109815 | A | 10/2013 |
| KR | 10-2015-0108994 | A | 10/2015 |
| WO | WO 2006/005033 | A2 | 1/2006 |

OTHER PUBLICATIONS

Office Action dated Jan. 24, 2019 from the Chinese Patent Office for corresponding Chinese Patent Application No. 201510387902.X.

* cited by examiner

DRIVING UNIT, DISPLAY DEVICE AND METHOD OF DRIVING A DISPLAY PANEL

CROSS-REFERENCE TO RELATED APPLICATION

Korean patent Application No. 10-2014-0147789, filed on Oct. 28, 2014, and entitled: "Driving Unit, Display Device and Method of Driving a Display Panel," is incorporated by reference herein in its entirety.

BACKGROUND

1. Field

One or more embodiments described herein relate to a driving unit, a display device, and a method for driving a display panel.

2. Description of the Related Art

A display device having limited gray levels may perform a dithering operation to represent other gray levels. Through the dithering operation, the display device may be able to represent more than an available number of gray levels.

An organic light emitting diode (OLED) display generates images using self-light-emitting elements, e.g., OLED. Compared with other types of flat panel displays, OLED displays have lower power consumption, a wider viewing angle, and are thinner. However, OLED displays generally have a shorter life span. In particular, OLEDs emitting blue light have a shorter life span than OLEDs emitting red or green light.

As a result, when the OLED display generates an image including a still image portion for a long period of time, the degree of deterioration of a pixel that displays the still image portion may be significantly different from other pixels. Thus, even if the pixels receive the same data signal, the pixels may emit light with different luminances. This may produce what is commonly referred to as an afterimage phenomenon.

SUMMARY

In accordance with one or more embodiments, a driver for a display panel includes a driving time accumulator to determine an accumulated driving time of the display panel; a ditherer to determine an amount of dither based at least in part on the accumulated driving time and to perform a dithering operation on input image data with the determined amount of dither; and a data signal generator to generate a data signal for the display panel based at least in part on the input image data on which the dithering operation is to be performed.

The ditherer may increase the amount of dither as the accumulated driving time increases. The ditherer may decrease a number of gray levels to be used in the dithering operation as the accumulated driving time increases. The ditherer may increase a size of a unit block to be used in the dithering operation as the accumulated driving time increases. The ditherer may compare the accumulated driving time with a predetermined threshold time, and may increase the amount of dither when the accumulated driving time exceeds the predetermined threshold time.

The display panel may include a plurality of pixels, and the driving time accumulator may calculate first accumulated pixel driving times for a first portion of a plurality of pixels based at least in part on the input image data, calculate second accumulated pixel driving times for a second portion of the pixels by interpolating the first accumulated pixel driving times, and determine the accumulated driving time of the display panel based at least in part on the first accumulated pixel driving times and the second accumulated pixel driving times.

The display panel may include a plurality of regions, and the driving time accumulator may determine accumulated region driving times for respective ones of the regions and may determine the accumulated driving time of the display panel based at least in part on the accumulated region driving times. The ditherer may selectively perform the dithering operation on each of the regions by determining whether to perform the dithering operation on each of the regions based at least in part on the accumulated region driving time of each of the regions. The ditherer may perform the dithering operation on the respective regions with different amounts of dither based at least in part on the accumulated region driving times of the respective regions.

The driver may include a still image analyzer to analyze a location of a still image. The ditherer may perform the dithering operation with a first amount of dither on a first one of the regions where the still image is not displayed, and may perform the dithering operation with a second amount on a second one of the regions where the still image is displayed, the second amount of dither greater than the first amount of dither. The still image may include a logo image.

In accordance with one or more other embodiments, a display device includes a display panel including a plurality of pixels; and a driver to drive the display panel and including: a driving time accumulator to determine an accumulated driving time of the display panel; a ditherer to determine an amount of dither based at least in part on the accumulated driving time and to perform a dithering operation on input image data with the determined amount of dither; and a data signal generator to generate a data signal for the display panel based at least in part on the input image data on which the dithering operation is performed.

The ditherer may increase the amount of dither as the accumulated driving time increases. The ditherer may decrease a number of gray levels to be used in the dithering operation as the accumulated driving time increases. The ditherer may increase a size of a unit block to be used in the dithering operation as the accumulated driving time increases. The ditherer may compare the accumulated driving time with a predetermined threshold time, and increase the amount of dither when the accumulated driving time exceeds the predetermined threshold time.

The display panel may includes a plurality of regions, and the driving time accumulator may determine accumulated region driving times for respective ones of the regions and may determine the accumulated driving time of the display panel based at least in part on the accumulated region driving times. The ditherer may selectively perform the dithering operation on each of the regions by determining whether to perform the dithering operation on each of the regions based at least in part on the accumulated region driving time of each of the regions.

In accordance with one or more other embodiments, a method for driving a display panel includes determining an accumulated driving time of the display panel; performing a dithering operation on input image data with an amount of dither determined based at least in part on the accumulated driving time; and generating a data signal for the display panel based at least in part on the input image data on which the dithering operation is performed.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
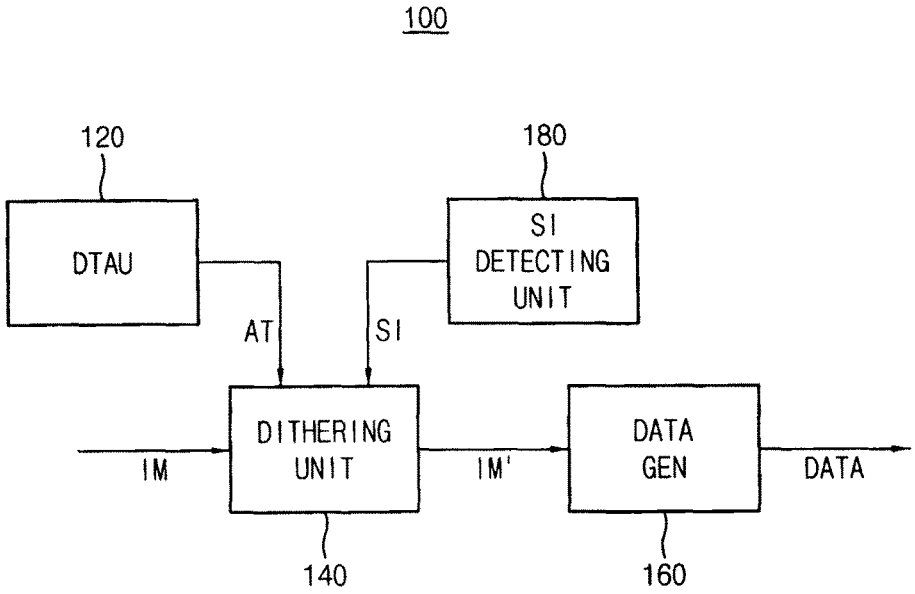
FIG. 1 illustrates an embodiment of a driving unit for a display panel.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout. Embodiments may be combined to form other embodiments.

FIG. 1 illustrates an embodiment of a driving unit 100 for driving a display panel. Referring to FIG. 1, the driving unit 100 includes a driving time accumulating unit 120, a dithering unit 140, and a data signal generating unit 160. In one embodiment, the driving unit 100 may further include a still image analyzing unit 180.

The driving time accumulating unit 120 determines an accumulated driving time AT of the display panel. The driving time accumulating unit 120 may estimate luminances of light emitted by respective pixels in the display panel based on gray levels to be represented by the respective pixels, and may determine the accumulated driving time AT based on the luminances of light emitted by the respective pixels. As the luminances of light emitted by the respective pixels increase, driving currents provided to the respective pixels may increase. Further, as the driving currents provided to the respective pixels are accumulated, degrees of deterioration of the respective pixels may increase. Accordingly, the accumulated driving time AT, determined based on the luminances of light emitted by the respective pixels by the driving time accumulating unit 120, may correspond to the degrees of deterioration of the respective pixels.

Consider, for example, a display device in which a gamma value is set to about 2.2 and the maximum luminance for the maximum gray level is set to about 350 nit. In this case, gray levels of 3, 7, and 82 may correspond to luminances of about 10 nit, about 40 nit, and about 200 nit, respectively. When a pixel sequentially represents the gray level of 82, the gray level of 3, and the gray level of 7, the driving time accumulating unit 120 may determine the accumulated driving time AT by accumulating values corresponding to about 200 nit, about 10 nit, and about 40 nit. Thus, the driving time accumulating unit 120 may estimate the degrees of deterioration of the pixels by analyzing input image data IM, without measuring lights emitted by the pixels.

The display panel may include a plurality of pixels. In this case, the driving time accumulating unit 120 may calculate first accumulated pixel driving times for a portion of the pixels based on input image data IM. Further, the driving time accumulating unit 120 may calculate second accumulated pixel driving times for the remaining portion of the pixels, by interpolating the first accumulated pixel driving times for the portion of the pixels. As a result, the driving time accumulating unit 120 may determine the accumulated driving time AT of the display panel based on the first accumulated pixel driving times and the second accumulated pixel driving times.

In one example embodiment, the driving time accumulating unit 120 may calculate the accumulated pixel driving times for all pixels in the display panel based on the input image data IM. However, calculating the accumulated pixel driving times for all pixels based on the input image data IM may require a long process time.

In another example embodiment, first accumulated pixel driving times may be calculated for a portion of the pixels based on the input image data IM, and second accumulated pixel driving times for the remaining portion of the pixels may be calculated by interpolating the first accumulated pixel driving times for the portion of the pixels. For example, when the first accumulated pixel driving times of a first pixel, a second pixel, and a third pixel are calculated as a value of 107 (e.g., 107 hours), a value of 53 (e.g., 53 hours), and a value of 13 (e.g., 13 hours) based on the input image data IM, respectively, the second accumulated pixel driving time of a fourth pixel between the first pixel and the second pixel may be calculated as a value between 107 and 53. This may be accomplished by interpolating the first accumulated pixel driving times of the first pixel and the second pixel The second accumulated pixel driving time of a fifth pixel located between the second pixel and the third pixel may be calculated as a value between 53 and 13. This may be accomplished by interpolating the first accumulated pixel driving times of the second pixel and the third pixel. In one example embodiment, the driving time accumulating unit 120 may perform the interpolation according to a linear interpolation algorithm. In another example embodiment, the driving time accumulating unit 120 may perform the interpolation according to a nonlinear interpolation algorithm.

However, when the accumulated pixel driving times for most of the pixels are calculated by interpolation (e.g., when the number of pixels having accumulated pixel driving times calculated based the input image data IM is excessively small, e.g., under a predetermined number), the accumulated driving time AT of the display panel may not accurately reflect the degree of deterioration of the display panel. Therefore, the number of pixels having accumulated pixel driving times calculated based on the input image data IM may be selected to satisfy both efficiency of the calculation and accuracy of the calculation.

In one example embodiment, the display panel may be divided into a plurality of regions, and the driving time accumulating unit 120 may determine the accumulated driving time AT of the display panel by determining accumulated region driving times for the regions, respectively. The accumulated driving time AT of the display panel may be or be based on, for example, an average of the accumulated region driving times.

The dithering unit 140 determines the amount of dither based on the accumulated driving time AT, and performs a dithering operation on the input image data IM with the determined amount of dither. In one example embodiment, as the accumulated driving time AT increases, the dithering unit 140 may increase the amount of dither. An afterimage phenomenon may occur in a display panel having a high degree of deterioration. However, even when the display panel has the high degree of deterioration, an afterimage phenomenon may be reduced or prevented since the dithering unit 140 performs the dithering operation with an increased amount of dither.

For example, even if a pixel has a high degree of deterioration, error caused by the deterioration of the pixel may be dispersed to adjacent pixels by the dithering operation. As a result, the afterimage phenomenon caused by a difference between differing degrees of deterioration of the pixel and the adjacent pixels may be reduced or prevented. One example of dispersing the error caused by the deterioration of the pixel is described with reference to FIGS. 3 and 4.

In one example embodiment, the dithering unit 140 may decrease the number of gray levels used in the dithering operation as the accumulated driving time AT increases. To decrease the number of gray levels in the dithering operation, the dithering unit 140 may perform the dithering operation with an amount of dither to represent gray levels which are not used in the dithering operation.

For example, when, among 256 gray levels (or in case of 8-bit input image data), 200 gray levels are used in the dithering operation, the remaining 56 gray levels may be represented by the dithering operation using the 200 gray levels. Further, when the number of the gray levels used in the dithering operation is reduced from 200 to 100, the remaining 156 gray levels may be represented by the dithering operation using the 100 gray levels. In this case, the dithering unit 140 may increase the amount of dither. For example, the dithering unit 140 may increase the amount of dither by decreasing the number of gray levels used in the dithering operation as the accumulated driving time AT increases.

In one example embodiment, the dithering unit 140 may increase the size of a unit block used in the dithering operation as the accumulated driving time AT increases. When the size of the unit block used in the dithering operation increases, the number of pixels in each unit block may increase. Thus, the amount of dither may be increased, since the dithering unit 140 performs the dithering operation using the unit block having an increased number of pixels.

For example, when the size of the unit block used in the dithering operation is increased from a size corresponding to four pixels to a size corresponding to nine pixels, or from a size corresponding to nine pixels to a size corresponding to sixteen pixels, the dithering unit 140 may perform the dithering operation with the increased amount of dither. The dithering unit 140 may increase the amount of dither, for example, by increasing the size of the unit block used in the dithering operation as the accumulated driving time AT increases.

In one example embodiment, the dithering unit 140 may compare the accumulated driving time AT with a predetermined threshold time, and may increase the amount of dither when the accumulated driving time AT exceeds the predetermined threshold time. Although the amount of dither may be continuously increased as the accumulated driving time AT increases in other example embodiments, the amount of dither may be discontinuously increased each time the accumulated driving time AT reaches at least one predetermined threshold time in another embodiment.

For example, the dithering unit 140 may perform the dithering operation with a first amount of dither until the accumulated driving time AT reaches a first threshold time. However, when the accumulated driving time AT reaches the first threshold time, the dithering unit 140 may perform the dithering operation with a second amount of dither greater than the first amount of dither. Furthermore, the dithering unit 140 may perform the dithering operation with the second amount of dither until the accumulated driving time AT reaches a second threshold time. An example where the dithering unit 140 performs the dithering operation with the amount of dither that is discontinuously increased is described with reference to FIG. 2.

In one example embodiment, the dithering unit 140 may selectively perform the dithering operation on each region. For example, the dithering unit 140 may determine whether to perform the dithering operation on each region based at least in part on the accumulated region driving time of the each region. For example, the dithering unit 140 may selectively perform the dithering operation on the respective regions based on the corresponding accumulated region driving times, respectively.

For example, the dithering unit 140 may not perform the dithering operation on a first region having an accumulated region driving time does not reach the first threshold time. However, the dithering unit 140 may perform the dithering operation on a second region having an accumulated region driving time which exceeds the first threshold time. By determining whether to perform the dithering operation on the respective regions, unnecessary dithering operations may not be performed.

In one example embodiment, the dithering unit 140 may perform the dithering operation on respective regions with different amounts of dither, based at least in part on the accumulated region driving times of the respective regions. For example, the dithering unit 140 may perform the dithering operation with a first amount of dither on a first region having an accumulated region driving time that does not reach the first threshold time. Further, the dithering unit 140 may perform the dithering operation with a second amount of dither greater than the first amount of dither on a second region having an accumulated region driving time that exceeds the first threshold time. By performing the dithering operation by the different amounts of dither on the respective regions, the amounts of dither may be optimized for the respective regions.

In some example embodiments, the dithering unit 140 may perform the dithering operation with a first amount of dither on a first region where a still image is not displayed. The dithering unit 140 may perform the dithering operation with a second amount of dither greater than the first amount of dither on a second region where the still image is displayed.

The driving unit 100 may further include a still image analyzing unit 180 that analyzes a location SI of the still image. In this case, the dithering unit 140 may determine the second amount of dither for the second region where the still image is displayed as being greater than the first amount of dither for the first region where the still image is not displayed. In one example embodiment, the still image may be a logo image. In a region where the logo or other still image is displayed (e.g., at the top-right of the display panel), the afterimage phenomenon may occur since a difference of degrees of deterioration between adjacent pixels may be great according to whether the respective pixels display the logo image.

However, the dithering unit 140 may perform the dithering operation on the region where the still image is displayed with an amount of dither greater than those of the other regions, thereby preventing the afterimage phenomenon. For example, the still image analyzing unit 180 may determine that the still image is located at the top-right of the display panel when a logo image of a (e.g., TV) broadcasting station or an icon representing a radiowave receiving sensitivity (e.g., in a smart phone, a tablet, etc.) is located at the top-right of the display panel. In this case, the dithering unit 140 may perform the dithering operation on the top-right region of the display panel with an amount of dither greater than those of other regions.

In one example embodiment, the data signal generating unit 160 may generate a data signal DATA to be provided to the display panel based at least in part on the input image data IM' on which the dithering operation is performed. The generated data signal DATA may be provided to a target pixel in the display panel during an active period of a scan signal. The pixels may emit light based at least in part on the provided data signal DATA. In one example embodiment, the pixels may be provided with an emission signal and may emit light during an active period of the emission signal.

In one case, the difference in the degrees of deterioration between the pixels the region where the still image is displayed may be greater than the difference in the degrees of deterioration between the pixels in surrounding regions. In this case, as described above, the still image analyzing unit 180 analyzes the location SI of the still image such that the still image is located at the region where the still image is displayed. The dithering unit 140 may perform the dithering operation on the region represented by the location SI of the still image with an amount of dither greater than those of the surrounding regions. Therefore, even if there is a difference in the degrees of deterioration between the pixels in the region where the still image is displayed, the dithering unit 140 may perform the dithering operation on the region where the still image is displayed with an amount of dither greater than those of the surrounding regions. This may reduce or prevent the afterimage phenomenon.

Figure 2:
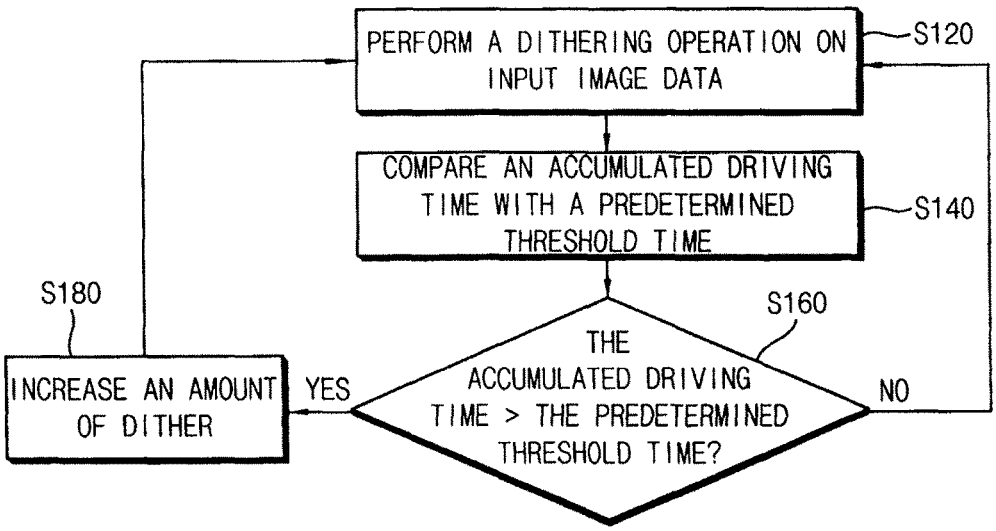
FIG. 2 illustrates an example of a dithering operation by the driving unit.

FIG. 2 illustrates an example of a dithering operation performed by the driving unit 100 of FIG. 1, where the dithering operation is performed with an increased amount of dither. Referring to FIG. 2, the dithering unit 140 performs a dithering operation (S120). For example, the dithering unit 140 may perform the dithering operation with an initially set amount of dither.

The dithering unit 140 may perform the dithering operation with an amount of dither that is increased as an accumulated driving time increases. In one example embodiment, the dithering unit 140 compares the accumulated driving time with a predetermined threshold time (S140). When the accumulated driving time is less than or equal to the predetermined threshold time (S160: NO), the dithering unit 140 may again perform the dithering operation with the previous amount of dither (e.g., the initially set amount of dither) (S120). However, when the accumulated driving time is greater the predetermined threshold time (S160: YES), the dithering unit 140 may increase the amount of dither (S180), and may perform the dithering operation with the increased amount of dither (S120).

For example, when three threshold times are set as 10 hours, 20 hours, and 30 hours, respectively, the dithering unit 140 may increase the amount of dither by a first increment when the accumulated driving time reaches 10 hours, may further increase the amount of dither by a second increment when the accumulated driving time reaches 20 hours, and may further increase the amount of dither by a third increment when the accumulated driving time reaches 30 hours. The first, second and third increments may have the same or different values. Further, according to one example embodiment, the threshold times may be set with the same or different intervals or may be irregularly set. For example, threshold times may be regularly set as 1 hour, 3 hours, 5 hours, 7 hours, etc. with the same interval of 2 hours. Alternatively, may be differently or irregularly set as 2 hours, 11 hours, 31 hours, etc. By repeating this process, the dithering unit may increase the amount of dither as the accumulated driving time increases.

Figure 3:
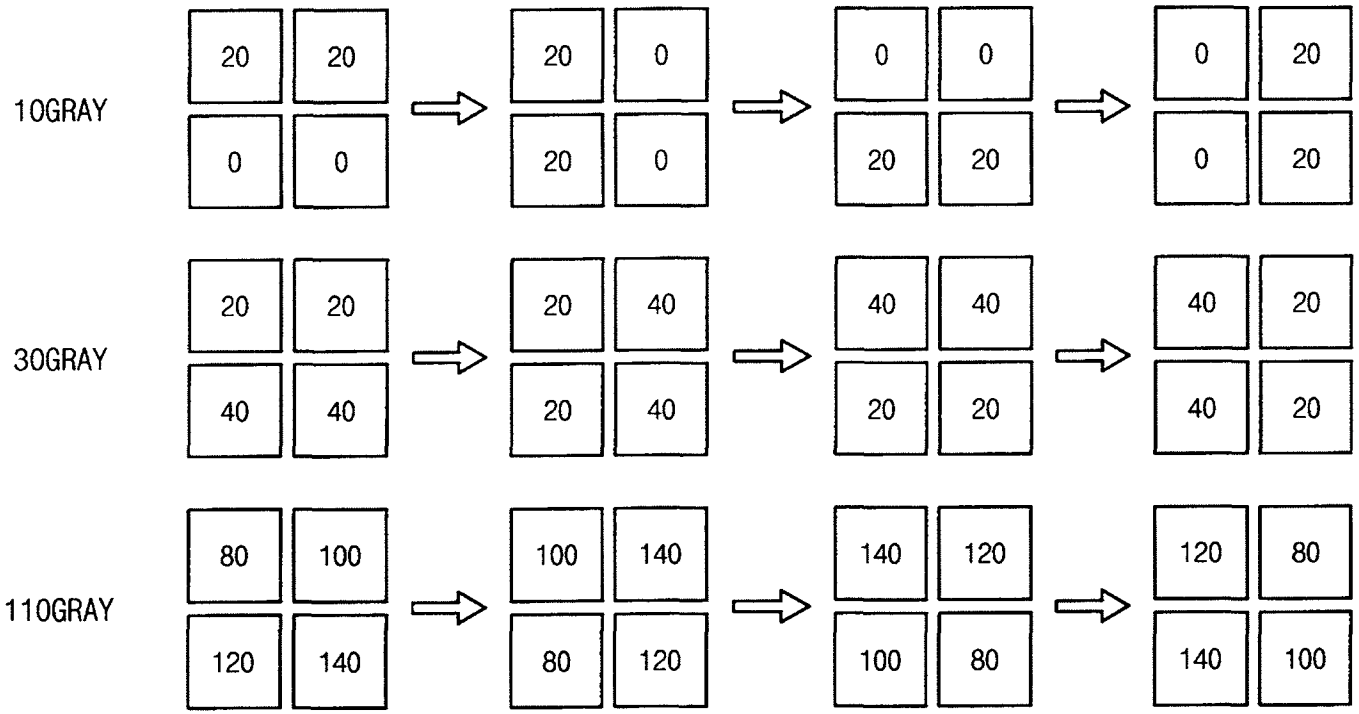
FIG. 3 illustrates an example of unused gray levels in the driving unit.

FIG. 3 illustrates examples of unused gray levels in the driving unit 100 of FIG. 1 that performs a dithering operation. Referring to FIG. 3, gray levels of 10, 30, and 110 may be represented by a dithering operation using gray levels of 0, 20, 40, 80, 100, 120, and 140.

In one example embodiment, each unit block of the dithering operation may include a predetermined number of pixels, e.g., four pixels in this embodiment. To represent the gray level of 10, a dithering unit may allow two pixels of the four pixels to represent the gray level of 0 and may allow the remaining two pixels to represent the gray level of 20. The dithering unit may perform the dithering operation by rapidly switching the gray levels of the four pixels in the unit block such that the switching is not perceived by the human eye. As a result, the gray level of 10, which is an average of the gray levels of the four pixels, may be perceived by the human eye.

To represent the gray level of 30, the dithering unit may allow two pixels of the four pixels to represent the gray level of 20 and may allow the remaining two pixels to represent the gray level of 40. The dithering unit may perform the dithering operation by rapidly switching the gray levels of the four pixels in the unit block such that the switching is not perceived by the human eye. As a result, the gray level of 30, which is an average of the gray levels of the four pixels, may be perceived by the human eye.

To represent the gray level of 110, the dithering unit may allow the four pixels to represent the gray levels of 80, 100, 120, and 140, respectively. The dithering unit may perform the dithering operation by rapidly switching the gray levels of the four pixels in the unit block such that the switching is not perceived by the human eye. As a result, the gray level of 110, which is an average of the gray levels of the four pixels, may be perceived by the human eye.

In one example embodiment, the number of gray levels used in the dithering operation may be decreased and the amount of dither may be increased as an accumulated driving time increases. For example, when the number of gray levels used in the dithering operation is decreased, the dithering unit may perform the dithering operation with an increased amount of dither to represent gray levels that are not used in the dithering operation. Thus, when the number of gray levels used in the dithering operation is decreased from 7 (e.g., the above-mentioned gray levels of 0, 20, 40, 80, 100, 120, and 140) to 5, the dithering unit may increase the amount of dither to represent all the gray levels.

When the dithering operation is performed with an increased amount of dither, an error caused by deterioration of a pixel may be dispersed to adjacent pixels by the dithering operation. As a result, an afterimage phenomenon caused by a difference between degrees of deterioration of a pixel and its adjacent pixels may be reduced or prevented. For example, when the degree of deterioration of one pixel of the four pixels is greater than those of the remaining three pixels, the error of the one pixel may be dispersed to the three pixels by the dithering operation. This may reduce or prevent the afterimage phenomenon.

Figure 4:
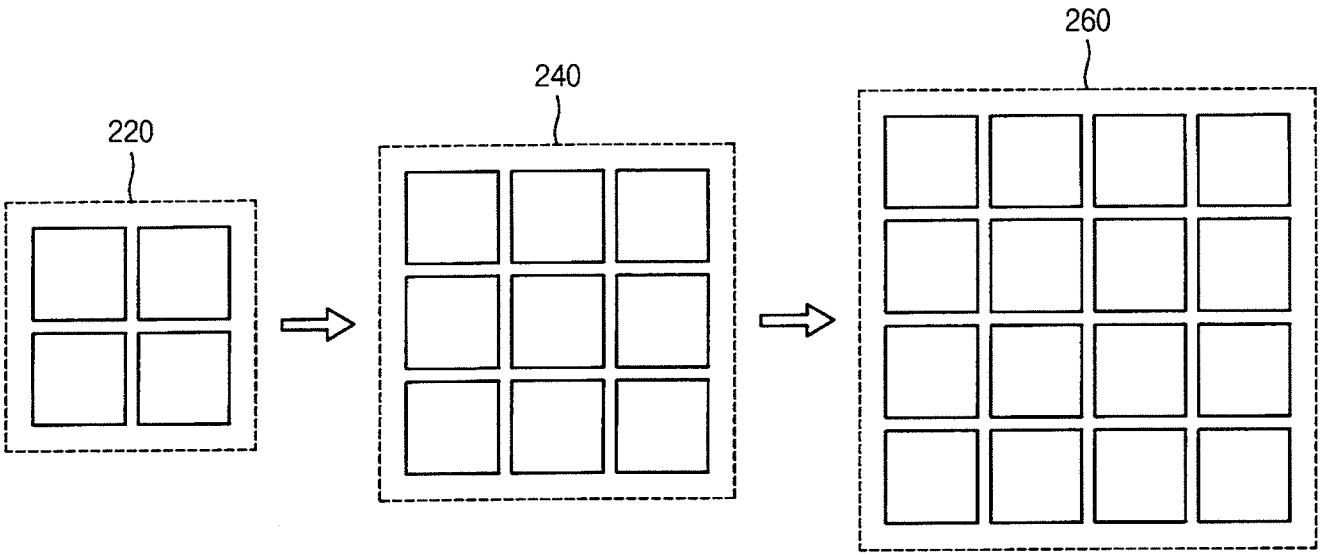
FIG. 4 illustrates an example of a size of a unit block in a dithering operation.

FIG. 4 illustrates an example of the size of a unit block used in a dithering operation performed by a driving unit of FIG. 1. Referring to FIG. 4, a dithering unit may increase the size of a unit block on which a dithering operation is performed as an accumulated driving time increases. For example, the size of the unit block on which the dithering operation is performed may be increased from a first size 200 corresponding to four pixels to a second size 240 corresponding to nine pixels, and may be further increase from the second size 240 corresponding to nine pixels to a third size 260 corresponding to sixteen pixels, as the accumulated driving time increases.

In one embodiment, the unit block may have the first size 220 until the accumulated driving time reaches a first threshold time. The unit block may have the second size 240 when the accumulated driving time is between the first threshold time until and a second threshold time. When the accumulated driving time reaches the second threshold time, the unit block may have third size 260.

In one example embodiment, the number of pixels in the unit block may be increased when the size of the unit block of the dithering operation is increased. When the dithering unit performs the dithering operation with the increased amount of dither, error caused by deterioration of a pixel may be dispersed to adjacent pixels by the dithering operation. As a result, an afterimage phenomenon caused by differing degrees of deterioration of the pixel and the adjacent pixels may be reduced or prevented. For example, the size of the unit block is increased from the first size 220 to the second size 240, error of one pixel may be dispersed to more pixels. This may reduce or prevent the afterimage phenomenon.

Figure 5:
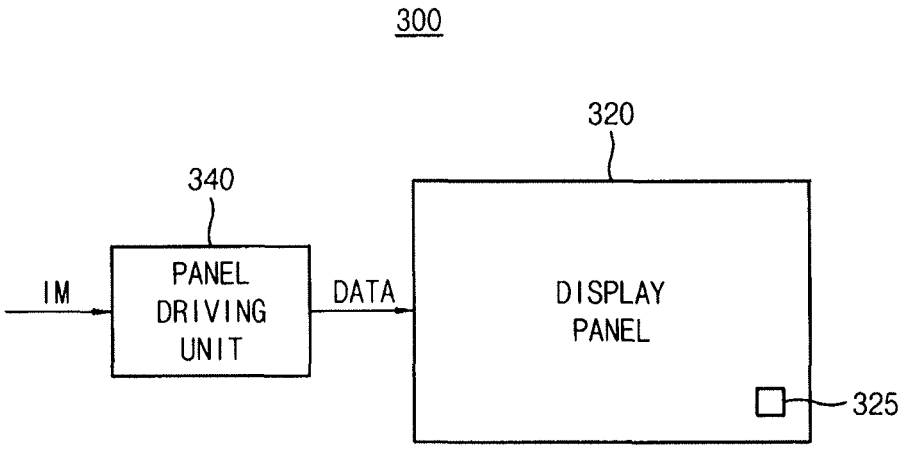
FIG. 5 illustrates an embodiment of a display device.

FIG. 5 illustrates an embodiment of a display device 300 which includes a display panel 320 and a driving unit 340 for the display panel 320. The display panel 320 may include a plurality of pixels 325. The driving unit 340 may drive the display panel 320. For example, the driving unit 340 may provide a data signal DATA to the display panel 320 based at least in part on input image data IM.

The driving unit 340 may include a driving time accumulating unit, a dithering unit, and a data signal generating unit. The driving time accumulating unit may determine an accumulated driving time of the display panel 320. The driving time accumulating unit may estimate luminances of light emitted by the respective pixels 325 in the display panel 320 based at least in part on gray levels to be represented by the pixels 325.

The driving time accumulating unit may determine an accumulated driving time based at least in part on the luminances of light emitted by the respective pixels 325. As the luminances of light emitted by the pixels 325 increase, driving currents provided to the respective pixels 325 may increase. Further, as the driving currents provided to respective pixels 325 are accumulated, degrees of deterioration of the respective pixels 325 may increase. Accordingly, the accumulated driving time AT, determined based on the luminances of light emitted by the respective pixels by the driving time accumulating unit 120, may correspond to the degrees of deterioration of the respective pixels.

In one example embodiment, the driving time accumulating unit may calculate first accumulated pixel driving times for a portion of the pixels based on input image data IM. Further, the driving time accumulating unit may calculate second accumulated pixel driving times for the remaining portion of the pixels by interpolating the first accumulated pixel driving times for the portion of the pixels. As a result, the driving time accumulating unit may determine the accumulated driving time AT of the display panel based on the first accumulated pixel driving times and the second accumulated pixel driving times.

In one example embodiment, the driving time accumulating unit may calculate the accumulated pixel driving times for all pixels 325 in the display panel based on the input image data IM. However, calculating the accumulated pixel driving times for all pixels 325 based on the input image data IM may require a long process time. In another example embodiment, first accumulated pixel driving times may be calculated for a portion of the pixels 325 based on the input image data IM and second accumulated pixel driving times for the remaining portion of the pixels 325 may be calculated by interpolating the first accumulated pixel driving times for the portion of the pixels 325.

For example, when the first accumulated pixel driving times of a first pixel, a second pixel, and a third pixel are calculated as a value of 107 (e.g., 107 hours), a value of 53 (e.g., 53 hours) and a value of 13 (e.g., 13 hours) based on the input image data IM, respectively, the second accumulated pixel driving time of a fourth pixel between the first pixel and the second pixel may be calculated as a value between 107 and 53 by interpolating the first accumulated pixel driving times of the first pixel and the second pixel. The second accumulated pixel driving time of a fifth pixel between the second pixel and the third pixel may be calculated as a value between 53 and 13 by interpolating the first accumulated pixel driving times of the second pixel and the third pixel.

The driving time accumulating unit may perform interpolation, for example, according to a linear interpolation algorithm or a nonlinear interpolation algorithm.

However, when the accumulated pixel driving times for most of the pixels 325 are calculated by the interpolation (e.g., when the number of the pixels 325 of which the accumulated pixel driving times are calculated based the input image data IM is excessively small, e.g., below a predetermined value), the accumulated driving time AT of the display panel 320 may not accurately reflect the degree of deterioration of the display panel. Therefore, the number of the pixels 325, of which the accumulated pixel driving times are calculated based the input image data IM, may be selected to satisfy both calculation efficiency and calculation accuracy.

In one example embodiment, the display panel 320 may be divided into a plurality of regions, and the driving time accumulating unit may determine the accumulated driving time of the display panel 320 by determining accumulated region driving times for the regions, respectively.

In one example embodiment, the dithering unit may determine the amount of dither based on the accumulated driving time, and may perform a dithering operation on the input image data IM with the determined amount of dither. In one example embodiment, the dithering unit may increase the amount of dither as the accumulated driving time increases. An afterimage phenomenon may occur in a display panel 320 having a high degree of deterioration. However, even if the display panel has a high degree of deterioration, the afterimage phenomenon may be reduced or prevented because the dithering unit performs the dithering operation with an increased amount of dither.

In one example embodiment, the dithering unit may decrease the number of gray levels used in the dithering operation as the accumulated driving time increases. To decrease the number of gray levels in the dithering operation, the dithering operation may be performed with an amount of dither to represent gray levels which are not used in the dithering operation.

In one example embodiment, the dithering unit may increase the size of a unit block used in the dithering operation as the accumulated driving time increases. When the size of the unit block in the dithering operation increases, the number of pixels included in each unit block may increase. Thus, the amount of dither may be increased since the dithering operation is performed using the unit block having the increased number of the pixels.

In one example embodiment, the dithering unit may compare the accumulated driving time with a predetermined threshold time, and may increase the amount of dither when the accumulated driving time exceeds the predetermined threshold time. The accumulated driving time may be increased in various ways. For example, the amount of dither may be continuously increased as the accumulated driving time increases or may be incrementally increased each time the accumulated driving time reaches at least one predetermined threshold time.

In one example embodiment, the dithering unit may selectively perform the dithering operation on each region by determining whether to perform the dithering operation on each region based, at least in part, on the accumulated region driving time of each region. For example, the dithering unit may selectively perform the dithering operation on the respective regions. By determining whether to perform the dithering operation on the respective regions, unnecessary dithering operations may not be performed.

In one example embodiment, the dithering unit may perform the dithering operation on the respective regions with different amounts of dither based, at least in part, on the accumulated region driving times of the respective regions. For example, the dithering unit may perform the dithering operation with a first amount of dither on a first region having an accumulated region driving time does not reach the first threshold time. The dithering unit may perform the dithering operation with a second amount of dither greater than the first amount of dither on a second region having an accumulated region driving time that exceeds the first threshold time. By performing the dithering operation with different amounts of dither on the respective regions, the amounts of dither may be optimized for the respective regions.

In one example embodiment, the dithering unit may perform the dithering operation with a first amount of dither on a first region where a still image is not displayed, and may perform the dithering operation with a second amount of dither greater than the first amount of dither on a second region where the still image is displayed.

The driving unit 340 may optionally include a still image analyzing unit that analyzes the location of the still image. In this case, the dithering unit may determine the second amount of dither for the second region where the still image is displayed as being greater than the first amount of dither for the first region where the still image is not displayed. The still image may be, for example, a logo image or another type of predetermined image. In a region where the still image is displayed (e.g., at the top-right of the display panel), the afterimage phenomenon may occur since a difference in degrees of deterioration between adjacent pixels may be great according to whether the respective pixels display the still image.

In one example embodiment, the data signal generating unit may generate the data signal DATA to be provided to the display panel 320 based, at least in part, on the input image data IM' on which the dithering operation is performed. The generated data signal DATA may be provided to a target pixel 325 in the display panel 320, for example, during an active period of a scan signal. The pixels may emit light based at least in part on the data signal DATA. In one example embodiment, the pixels 325 may be provided with an emission signal and may emit light during an active period of the emission signal.

The difference in the degrees of deterioration between the pixels in the region where the still image is displayed may be greater than a difference in the degrees of deterioration between the pixels in one or more of the surrounding regions. In this case, as described above, the still image analyzing unit analyzes the location of the still image to determine its location, and the dithering unit performs the dithering operation on the region represented by the location of the still image with an amount of dither greater than those of one or more of the surrounding regions. Therefore, even if there is a difference in the degree of deterioration between the pixels in the region where the still image is displayed, the dithering unit may perform the dithering operation on the region where the still image is displayed with an amount of dither greater than one or more of the surrounding regions. This may reduce or prevent the afterimage phenomenon.

Figure 6:
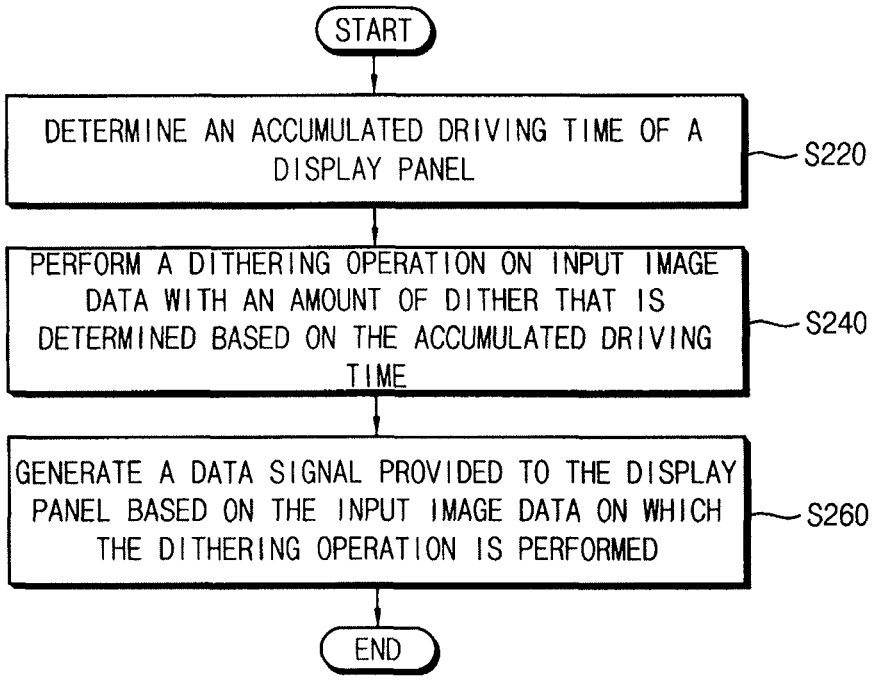
FIG. 6 illustrates an embodiment of a method for driving a display panel.

FIG. 6 illustrates an embodiment of a method for driving a display panel. The method includes determining an accumulated driving time of the display panel (S220), for example, by accumulating input image data.

A dithering operation may be performed on the input image data with an amount of dither that is determined, based at least in part, on the accumulated driving time (S240). In one example embodiment, the amount of dither may be increased as the accumulated driving time increases. Accordingly, an afterimage phenomenon caused by deterioration of the display panel may be reduced or prevented, even if a degree of deterioration of the display panel increases as the accumulated driving time increases. In one example embodiment, the amount of dither may be increased by decreasing the number of gray levels used in the dithering operation. In another example embodiment, the amount of dither may be increased by a size of a unit bock used in the dithering operation.

The data signal provided to the display panel may be generated based at least in part on the input image data on which the dithering operation is performed (S260). The generated data signal may be provided to a target pixel in the display panel, for example, during an active period of a scan signal. The pixels may emit light based at least in part on the provided data signal.

As a result, even if the degrees of deterioration of adjacent pixels are different from each other, an afterimage phenomenon may be reduced or prevented by performing the dithering operation with the amount of dither determined based on the accumulated driving time.

Figure 7:
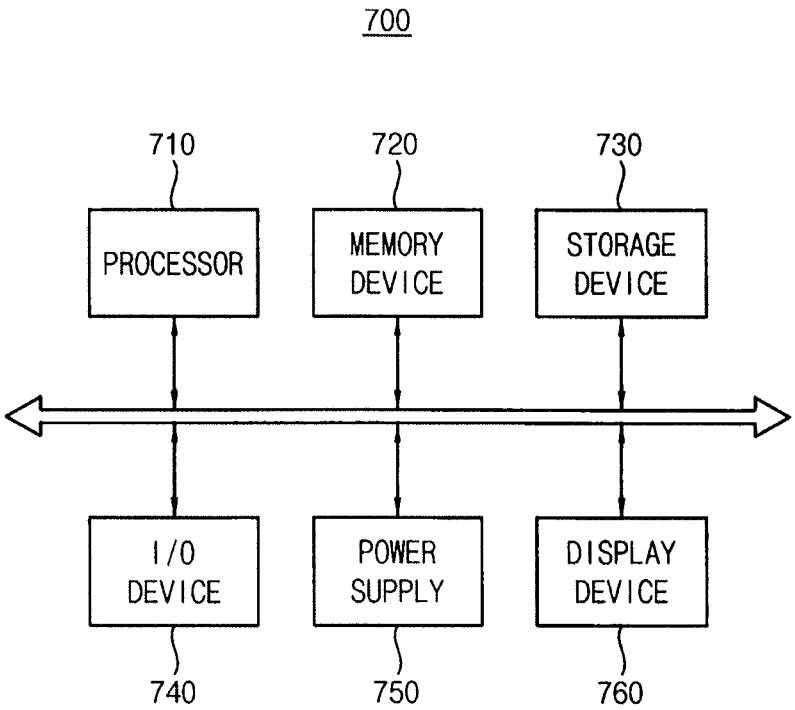
FIG. 7 illustrates an embodiment of an electronic device.

FIG. 7 illustrates an embodiment of an electronic device 700 which includes a processor 710, a memory device 720, a storage device 730, an input/output (I/O) device 740, a power supply 750, and a display device 760. The display device 760 may correspond to the display device 300 in FIG. 5. The electronic device 700 may further include a plurality of ports for communicating with a video card, a sound card, a memory card, a universal serial bus (USB) device, other electronic systems, etc.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the electronic device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, etc, and/or an output device such as a printer, a speaker, etc. The power supply 750 may supply power for operations of the electronic device 700.

The display device 760 may include a display panel and a driving unit for driving the display panel. The driving unit may include a driving time accumulating unit, a dithering unit, and a data signal generating unit.

The driving time accumulating unit may determine an accumulated driving time of the display pane. The dithering unit may perform a dithering operation on input image data with an amount of dither that is determined or adjusted based on the accumulated driving time. The data signal generating unit may generate a data signal for the display panel based on the input image data on which the dithering operation is performed. By the dithering operation, error caused by deterioration of a pixel may be dispersed to adjacent pixels, thereby reducing or preventing an afterimage phenomenon.

The accumulator, ditherer, signal generator, and other processing features of the embodiments described herein may be implemented in logic which, for example, may include hardware, software, or both. When implemented at least partially in hardware, the accumulator, ditherer, signal generator, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the accumulator, ditherer, signal generator, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, an organic light emitting diode display may generate an image including a still image portion for a long period of time. As a result, the degree of deterioration of a pixel that displays the still image portion may be significantly different from that of one or more other pixels. Accordingly, even if the two pixels receive the same data signal, the two pixels may have different luminance. This may cause an afterimage phenomenon to occur.

Several techniques have been proposed in an attempt to prevent the afterimage phenomenon. These techniques include stress boundary diffusion (SBD) that diffuses the still image, and image sticking compensation (ISC) that increases image data as the stress time increases. However, these techniques have proven inadequate.

In accordance with one or more of the aforementioned embodiments, a dithering unit performs a dithering operation with an amount of dither that is increased with accumulated driving time. In one or more of these embodiments, the dithering unit compares the accumulated driving time with a predetermined threshold time. When the accumulated driving time is less than or equal to the predetermined threshold time, the dithering unit may perform the dithering operation again with the previous amount of dither. However, when the accumulated driving time is greater than the predetermined threshold time, the dithering unit may increase the amount of dither and then may perform the dithering operation with the increased amount of dither.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A driver for a display panel, comprising:

a driving time accumulator to determine an accumulated driving time of the display panel for still and moving image data;

a ditherer to increase an amount of dither as the accumulated driving time increases and to perform a dithering operation on the image data with the increased amount of dither, the increased amount of dither including a decrease in a number of gray levels or an increase in a number of pixels in a unit block for the dithering operation; and a data signal generator to generate a data signal for the display panel based at least in part on the dithered image data.

2. The driver as claimed in claim 1, wherein the ditherer is to:

compare the accumulated driving time with a predetermined threshold time, and increase the amount of dither when the accumulated driving time exceeds the predetermined threshold time.

3. The driver as claimed in claim 1, wherein:

the display panel includes a plurality of pixels, and the driving time accumulator is to calculate first accumulated pixel driving times for a first portion of a plurality of pixels based at least in part on the image data, calculate second accumulated pixel driving times for a second portion of the pixels by interpolating the first accumulated pixel driving times, and determine the accumulated driving time of the display panel based at least in part on the first accumulated pixel driving times and the second accumulated pixel driving times.

4. The driver as claimed in claim 1, wherein:

the display panel includes a plurality of regions, and the driving time accumulator is to determine accumulated region driving times for respective ones of the regions and is to determine the accumulated driving time of the display panel based at least in part on the accumulated region driving times.

5. The driver as claimed in claim 4, wherein the ditherer is to selectively perform the dithering operation on each of the regions by determining whether to perform the dithering operation on each of the regions based at least in part on the accumulated region driving time of each of the regions.

6. The driver as claimed in claim 4, wherein the ditherer is to perform the dithering operation on the respective regions with different amounts of dither based at least in part on the accumulated region driving times of the respective regions.

7. The driver as claimed in claim 4, further comprising:

a still image analyzer to analyze a location of a still image.

8. The driver as claimed in claim 7, wherein the ditherer is to:

perform the dithering operation with a first amount of dither on a first one of the regions where the still image is not displayed, and perform the dithering operation with a second amount of dither on a second one of the regions where the still image is displayed, the second amount of dither being greater than the first amount of dither.

9. The driver as claimed in claim 7, wherein the still image includes a logo image.

10. A display device, comprising:

a display panel including a plurality of pixels and a plurality of regions; and a driver to drive the display panel, the driver including:

a driving time accumulator to determine accumulated region driving times for respective ones of the regions and to determine an accumulated driving time of the display panel based at least in part on the accumulated region driving times;

a ditherer to change an amount of dither based at least in part on the accumulated driving time and to perform a dithering operation on image data with the changed amount of dither; and a data signal generator to generate a data signal for the display panel based at least in part on the dithered image data.

11. The display device as claimed in claim 10, wherein the ditherer is to increase the amount of dither as the accumulated driving time increases.

12. The display device as claimed in claim 11, wherein the ditherer is to decrease a number of gray levels to be used in the dithering operation as the accumulated driving time increases.

13. The display device as claimed in claim 11, wherein the ditherer is to increase a size of a unit block to be used in the dithering operation as the accumulated driving time increases.

14. The display device as claimed in claim 11, wherein the ditherer is to:

compare the accumulated driving time with a predetermined threshold time, and increase the amount of dither when the accumulated driving time exceeds the predetermined threshold time.

15. The display device as claimed in claim 10, wherein the ditherer is to:

selectively perform the dithering operation on each of the regions by determining whether to perform the dithering operation on each of the regions based at least in part on the accumulated region driving time of each of the regions.

16. A method for driving a display panel, the method comprising:

determining an accumulated driving time of the display panel for still and moving image data;

performing a dithering operation on the image data with an amount of dither that is increased as the accumulated driving time increases, the increased amount of dither including a decreased number of gray levels or an increased a number of pixels in a unit block for the dithering operation; and generating a data signal for the display panel based at least in part on the image data on which the dithering operation is performed.

17. The display device as claimed in claim 10, wherein the ditherer is to perform the dithering operation on the respective regions with different amounts of dither based at least in part on the accumulated region driving times of the respective regions.

* * * * *